United States Patent [19]

Sugiyama

[11] 4,402,266

[45] Sep. 6, 1983

[54] FRONT LAY DEVICE FOR SHEET-FED ROTARY PRINTING PRESSES

[75] Inventor: Hiroyuki Sugiyama, Toride, Japan

[73] Assignee: Komori Printing Machinery Co. Ltd., Japan

[21] Appl. No.: 371,407

[22] Filed: Apr. 26, 1982

[30] Foreign Application Priority Data

May 8, 1981 [JP] Japan ..... 56-68243

[51] Int. Cl.[3] ..... B41F 21/04

[52] U.S. Cl. ..... 101/409; 271/245

[58] Field of Search ..... 101/409, 410, 232; 271/226, 243, 244, 245, 246, 247, 253–255

[56] References Cited

U.S. PATENT DOCUMENTS

| | | | |
|---|---|---|---|
| 2,831,425 | 4/1958 | Schunemann | 101/232 |
| 2,976,038 | 3/1961 | Whyte | 271/245 X |
| 2,984,482 | 5/1961 | Kist et al. | 271/246 X |
| 3,116,923 | 1/1964 | Gunther | 101/409 |
| 3,637,202 | 1/1972 | Mowry et al. | 101/409 X |
| 3,829,085 | 8/1974 | Jeschke et al. | 271/231 |

FOREIGN PATENT DOCUMENTS

| | | | |
|---|---|---|---|
| 203267 | 9/1956 | Australia | 271/245 |
| 242342 | 12/1962 | Australia | 271/245 |
| 874453 | 4/1953 | Fed. Rep. of Germany | 271/245 |
| 2340168 | 2/1974 | Fed. Rep. of Germany | 101/409 |
| 235269 | 6/1925 | United Kingdom | 101/409 |

*Primary Examiner*—E. H. Eickholt

*Attorney, Agent, or Firm*—Remy J. VanOphem

[57] ABSTRACT

A front lay device for a sheet-fed rotary printing press comprising a feed table, a stop shaft disposed downwardly of a front end of the feed table and reciprocably angularly movable about its own axis, a stop holder mounted on the stop shaft and having a stop located adjacent to the front end of the feed table, a swingable hold-down member pivotably mounted by a pivot shaft on the stop holder and having a hook-shaped distal end disposed adjacent to the front end of the feed table, a cam shaft rotatable in synchronization with the stop shaft for driving the swingable hold-down member, and a link shaft drivable by the drive shaft for reciprocable movement about its own axis. The pivot shaft and the link shaft are operatively connected by a quadruplet link mechanism for lifting the swingable hold-down member from an upper surface of the front end of the feed table when a sheet is delivered onto the latter, and for bringing the swingable hold-down member toward the feed table to hold the sheet down against the feed table, while the stop shaft makes a single reciprocable angular movement.

4 Claims, 8 Drawing Figures

PRIOR ART

FRONT LAY DEVICE FOR SHEET-FED ROTARY PRINTING PRESSES

BACKGROUND OF THE INVENTION

The present invention relates to a front lay device disposed between a sheet feeder and a printing cylinder of a sheet-fed rotary printing press for holding the leading or gripping end of a sheet in position with respect to a printing plate.

Sheets as delivered one by one onto a feed table by a sheet feeder in a sheet-fed rotary printing press are stopped for positional control by a front lay device located at a front end of the feed table. The sheet is then gripped by a swing gripper mechanism and supplied thereby onto a printing cylinder. The front lay device includes a front stop movable downwardly toward the leading end of the sheet on the feed table. As modern printing presses operate at higher speeds, there is a tendency for a sheet held against the front stop to become unstable. In order to stabilize the sheet, it is necessary to supply sheets at shorter intervals causing the leading end of the next sheet to reach the position of the front stop before the trailing end of the previous sheet is fed out past the front stop. The front lay device having the downwardly movable front stop, however, fails to meet such a requirement.

To meet the high-speed requirement, there have widely been used front lay devices with a front stop movable obliquely upwardly at the front end of a feed table. These front lay devices however cannot be adjusted with ease. When the front lay device is not properly adjusted, sheets cannot be delivered smoothly, and the printing press often needs to be stopped due to improper sheet delivery. Once the printing press is stopped, a large spoilage of paper will occur before the printing press operates under a normal condition.

SUMMARY OF THE INVENTION

It is an object of the present invention to provide a front lay device for sheet-fed rotary printing presses which can prevent a sheet from passing over a swingable hold-down member when the sheet is delivered onto a feed table and yet can hold the sheet on the feed table stably for increased register accuracy.

According to the present invention, a swingable hold-down member is pivotably mounted by a pivot on a stop holder mounted on a stop shaft which is reciprocably angularly movable about its own axis. The pivot for the swingable hold-down member is operatively connected by a quadruplet link mechanism to a link shaft which is reciprocably angularly movable about its own axis by a shaft that is angularly movable in synchronization with the stop shaft for driving the swingable hold-down member. The swingable hold-down member can be moved toward and away from the upper surface of the front end of a feed table while the stop shaft makes one reciprocable motion. When a sheet is delivered onto the feed table, the swingable hold-down member is lifted away from the feed table to prevent the sheet from passing over the swingable hold-down member. When the sheet is to be positioned on the feed table, the swingable hold-down member is brought toward the feed table to hold the sheet down against the feed table stably for increased register accuracy.

The many objects, features and advantages of the present invention will become more apparent from the following description when taken in conjunction with the accompaying drawings in which a certain preferred embodiment is shown by way of illustrative example.

DETAILED DESCRIPTION

Figure 1:
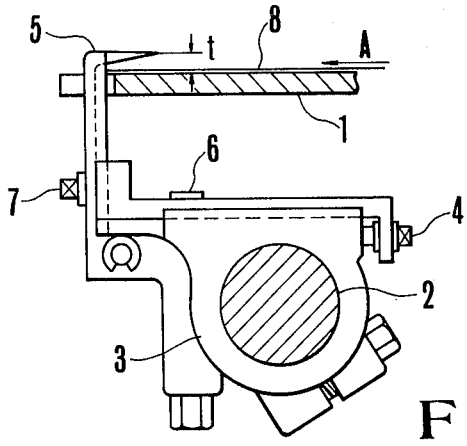
FIG. 1 is a side elevational view of a conventional front lay device for a sheet-fed rotary printing press.
Figure 4:
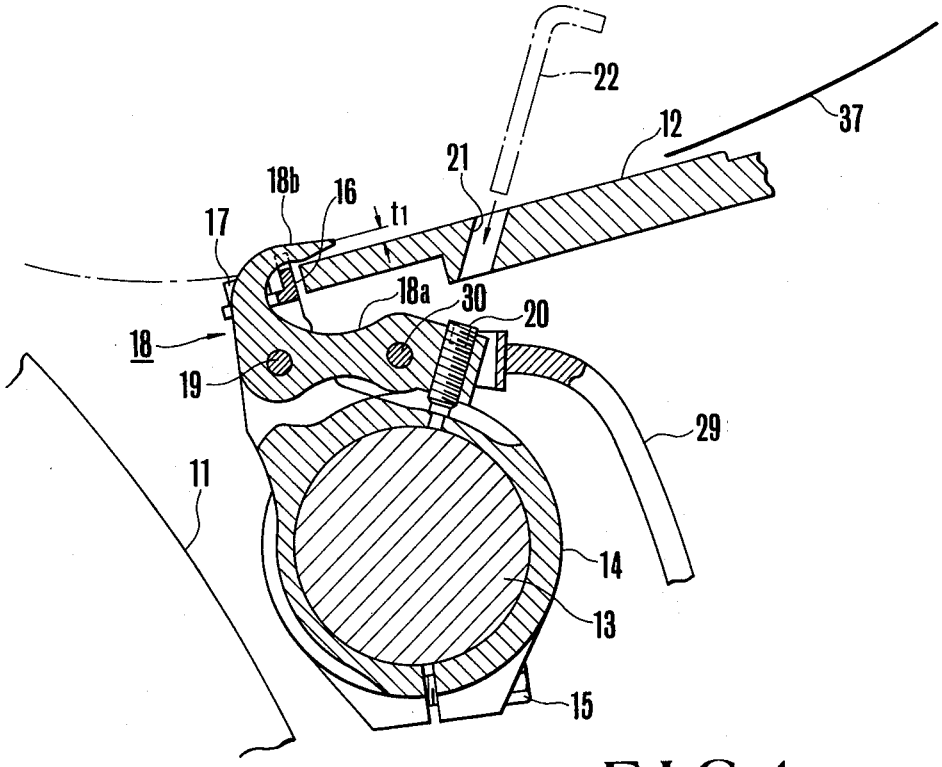
FIG. 4 is a fragmentary cross-sectional view of the front lay device.

FIG. 1 shows a conventional front lay device having a front stop which is movable obliquely upwardly. The front lay device includes a plurality of stop holders 3 mounted on a stop shaft 2 disposed downwardly of a feed table 1, and a front stop 5 which is adjustable by an adjustment screw 4 for lateral displacement (leftward or rightward as shown), the front stop 5 being fixed by bolts 6 to the stop holders 3. Upon loosening of a setscrew 7, the front stop 5 is vertically adjustable in position. When a sheet of paper 8 is delivered onto the feed table 1 in the direction of the arrow A and has its leading end held against the front stop 5 for positional control, the stop shaft 2 is turned counterclockwise about its own axis to cause the front stop 5 to be retracted downwardly obliquely leftward away from the front end of the feed table 1. Then, a swing gripper mechanism (not shown) comes downwardly obliquely rightward toward the feed table 1 to grip the end of the sheet of paper 8, and delivers the sheet of paper 8 upwardly obliquely leftward, whereupon the sheet of paper 8 is transferred to grippers and supplied thereby onto a printing cylinder. While the sheet of paper 8 is being delivered by the swing gripper mechanism, the stop shaft 2 is turned clockwise to allow the front stop 5 to return to the illustrated position for controlling the position of the following sheet of paper 8. The delivery of the sheet of paper 8 is not obstructed or disturbed by the front stop 5 as it returns before the trailing end of the sheet of paper 8 being delivered leaves the front end of the feed table 1. Thus, the front lay device shown in FIG. 1 can be used with high-speed printing presses.

When the front stop 5 is too high with an increased gap t between the front stop 5 and the feed table 1, the sheet of paper 8 is apt to become unstable on the feed table 1, lowering the register accuracy. The front stop 5 is then positionally adjusted to equalize the gap t with the thickness of two or three sheets. Once the gap t is adjusted, it is fixed; when the gap t is too small, the next sheet of paper 8, as it is delivered onto the feed table 1, often passes over the front stop 5. Each time a sheet of paper 8 passes over the front stop 5, the printing press must be stopped for a predetermined period of time, during which balancing between the ink and dampening solution may be lost. Such a condition produces a large spoilage of paper until the print press operates in a normal condition after it has started operating.

A front lay device according to the present invention is illustrated in FIGS. 2, 3, 4 and 5*a* through 5*d*.

Figure 2:
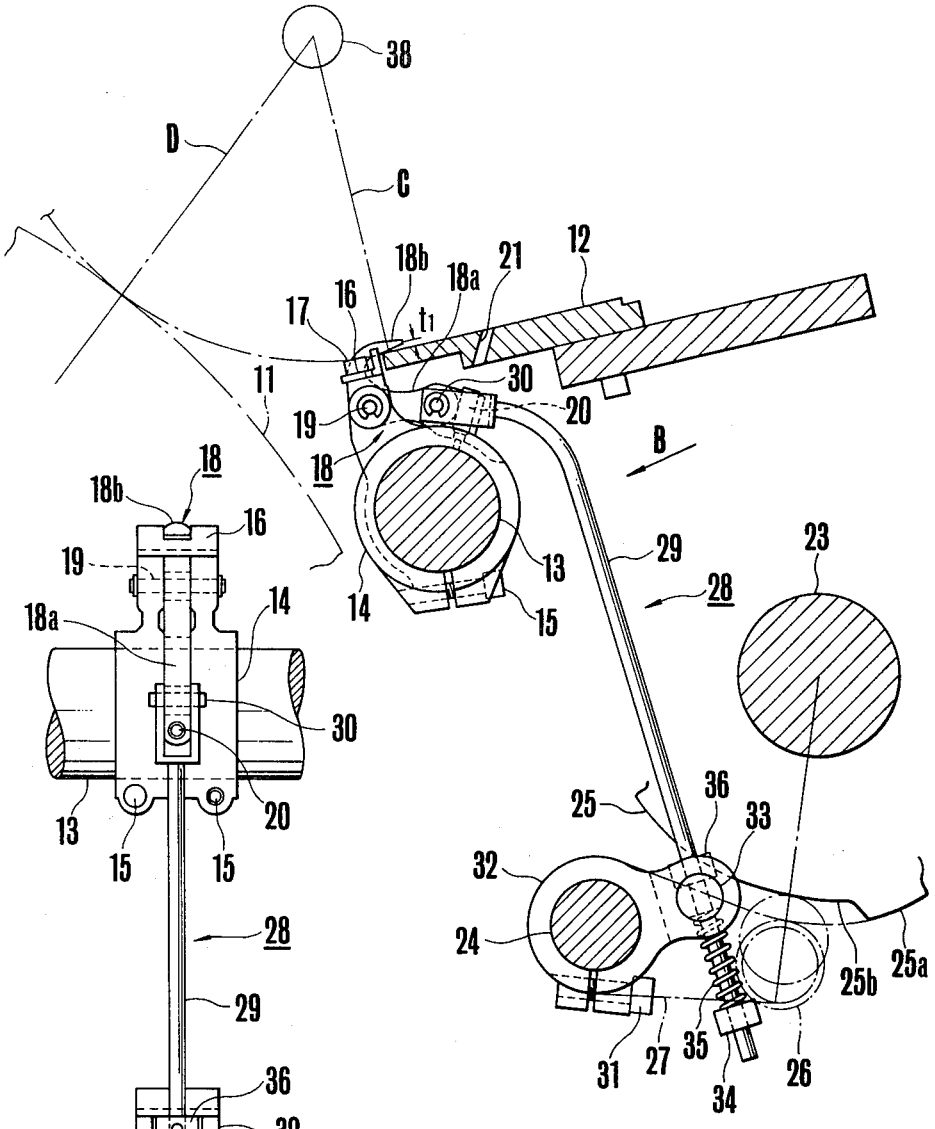
FIG. 2 is a side elevational view of a front lay device for a sheet-fed rotary printing press according to the present invention.
Figure 3:
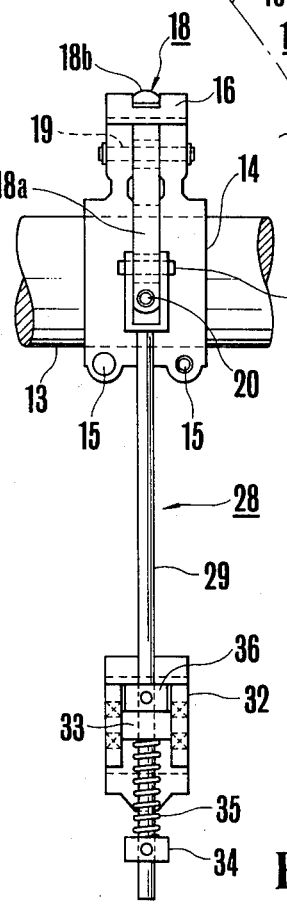
FIG. 3 is a rear view of the front lay device as seen in the direction of the arrow B of FIG. 2.

As shown in FIG. 2, a feed table 12 is disposed between an impression cylinder 11 rotatably supported in a printing unit and a sheet feeder, not shown. The feed table 12 has a width which is substantially the same as the length of the impression cylinder 11. The feed table 12 is inclined downwardly toward the impression cylinder 11. A stop shaft 13 is located downwardly of a front end of the feed table 12 for reciprocable angular movement about its own axis in one and opposite directions. A plurality of stop holders 14 are disposed around the stop shaft 13 and secured thereto by bolts 15. A stop 16 of an L-shaped cross section is attached by a bolt 17 to each of the stop holdlers 14, the stop 16 having a raised portion located adjacent the front end of the feed table 12. The stop 16 is mounted on an upper projection of the stop holder 14 and is adjustable for movement toward and away from the feed table 12. The stop holder 14 has an upper U-shaped portion on which there is pivotably mounted by a shaft 19 a swingable hold-down member 18 composed of a link portion 18*a* and a catch-hook portion 18*b*, as shown in FIG. 3. The catch-hook portion 18*b* has a distal end positioned over the distal end of the feed table 12 and extending substantially parallel thereto. An adjustment screw 20 extends threadedly through the link portion 18*a* of the swingable hold-down member 18. The adjustment screw 20 can be turned by a wrench 22 (FIG. 4) inserted through a through hole 21 defined in the feed table 12 to adjust a gap $t_1$ between the catch-hook portion 18*b* of the swingable hold-down member 18 and the upper surface of the feed table 12.

A cam shaft 23, which serves as a shaft for driving the swingable hold-down member 18, is rotatably disposed obliquely downwardly of the stop shaft 13. The cam shaft 23 is rotatable about its own axis in synchronization with the reciprocable angular movement of the stop shaft 13. A link shaft 24 is rotatably disposed obliquely downwardly of the cam shaft 23. A cam 25 having a larger-diameter portion 25*a* and a smaller-diameter portion 25*b* on a cam surface thereof is mounted on the cam shaft 23. The link shaft 24 supports thereon a cam lever 27 having a cam follower 26 rotatably mounted on a distal end thereof in abutting relation to the cam surface of the cam 25. The link shaft 24 and the shaft 19, on which the swingable hold-down member 18 is pivotably mounted, are operatively connected by a quadruplet link mechanism 28 with the shafts 24 and 19 serving as joints at two opposite ends of the quadruplet link mechanism 28.

The quadruplet link mechanism 28 includes a connecting rod 29 having an upper U-shaped end pivotably mounted by a pin 30 on the link portion 18*a* of the swingable hold-down member 18 and a lower end extending through a rod retainer 33 swingably mounted on a U-shaped distal end of a link 32 which is fastened by a bolt 31 to the link shaft 24 for rotation therewith. A compression coil spring 35 is disposed around the connecting rod 29 between the rod retainer 33 and a collar 34 on a lower end of the connecting rod 29 for normally urging the connecting rod 29 axially downwardly. The connecting rod 29 has thereon a collar 36 which prevents the connecting rod 29 from moving downwardly with the compression coil spring 35 being held slightly in compression. When the cam shaft 23 makes one revolution the link shaft 24 is angularly moved back and forth, causing the quadruplet link mechanism 28 to swing the swingable hold-down member 18, whereupon the catch-hook portion 18*b* thereof moves away from and toward the upper portion of the front end of the feed table 12.

A swing shaft 38 is disposed upwardly of the front lay device. The swing shaft 38 supports thereon a swing gripper mechanism (not shown) which is angularly reciprocably movable between angularly spaced positions shown by the dot-and-dash-lines C and D in FIG. 2 for gripping the end of a sheet placed on the feed table 12 and stopped by the front lay device and for delivering such a sheet toward grippers (not shown) that coact with the impression cylinder 11.

Figure 5A:
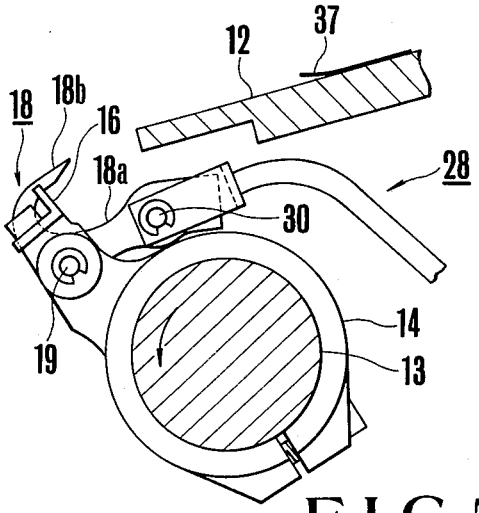
FIGS. 5*a* through 5*d* are side elevational views illustrative of progressive operations of the front lay device of the invention.
Figure 5B:
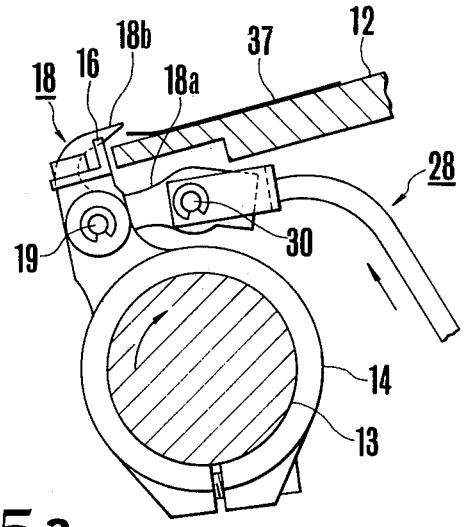
Figure 5C:
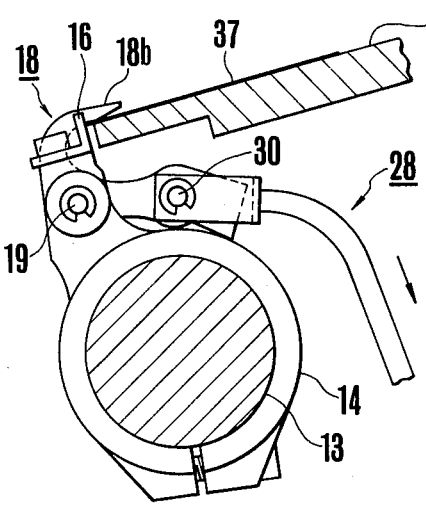
Figure 5D:
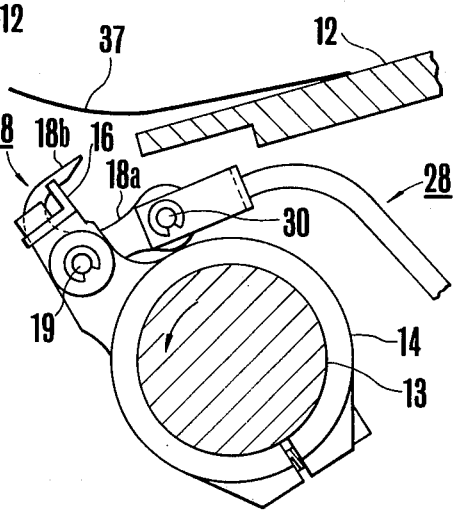

Operation of the front lay device of the invention is as follows: Prior to the printing operation, eccentric bearings, not illustrated, in which the stop shaft 13 is journalled, are angularly moved for the registration of a sheet 37, and the wrench 22 is inserted through the hole 21 in the feed table 12 and turned to advance or retract the adjustment screw 20 for adjusting the gap $t_1$ into conformity with the thickness of the sheet 37. When the printing operation is started, the sheet 37 is fed by sheet feeder rollers of the sheet feeder, not illustrated, onto the feed table 12 as shown in FIG. 5*a*. At this time, the stop shaft 13 has turned counterclockwise with the swingable hold-down member 18 retracted away from the feed table 12. Before the leading end of the sheet 37 reaches the front end of the feed table 12, the stop shaft 13 is turned clockwise to bring the swingable hold-down member 18 adjacent to the feed table 12. At the same time, the cam follower 26 is in contact with the smaller-diameter portion 25*b* of the cam 25, whereupon the swingable hold-down member 18 is turned counterclockwise via the quadruplet link mechanism 28. The leading end of the sheet 37 arrives at the front end of the feed table 12 from which the catch-hook portion 18*b* of the swingable hold-down member 18 is spaced upwardly. Therefore, even if the leading end of the sheet 37 is upturned or curved upwardly, it will not pass over the swingable hold-down member 18 as the latter is lifted upwardly of the feed table 12. Simultaneously with abutting engagement of the leading end of the sheet 37 with the stop 16, the cam follower 26 is brought into contact with the larger-diameter portion 25*a* of the cam 25, whereupon the swingable hold-down member 18 is angularly moved clockwise to cause the catch-hook portion 18*b* to move toward the upper surface of the front end of the feed table 12, substantially holding the sheet 37 as registered by the stop 16 down against the feed table, as shown in FIG. 5*c*. Therefore, the sheet 37 is stably retained on the feed table 12 against upward movement out of registration. With the sheet 37 thus held on the feed table 12, the swing gripper mechanism, not illustrated is moved over toward the feed table 12 to grip the leading end of the sheet 37. Since the swing gripper mechanism and the swingable hold-down mechanism 18 are displaced out of axial alignment with the stop shaft 13, they do not interfere with each other. When the swingable hold-down member 18 is retracted away from the feed table 12 to release the sheet 37 as illustrated in FIG. 5*d*, the swing gripper mechanism is angularly moved from the position C to the position D (FIG. 2) to feed the sheet 37 away from the feed table 12 toward the grippers coacting with the impression cylinder 11. Sheets can successively be fed onto the impression cylinder 11 through repeated operations as shown in FIGS. 5*a* through 5*d*.

With the arrangement of the present invention, the swingable hold-down member is raised above the feed table when a sheet is delivered onto the latter to prevent the sheet from passing over the swingable hold-down member. Accordingly, the printing press is free from unwanted stoppage which would otherwise result from accidental passing of sheets over the swingable hold-down member. The spoilage of paper is thus greatly reduced as compared with conventional front lay devices. When a sheet is to be positioned on the feed table, the swingable hold-down member is moved adjacent to the upper surface of the front end of the feed table, holding the leading end of the sheet down against the feed table. Thus, the sheet can stably be placed on the feed table against upward movement out of registration, and the required degree of register accuracy is retained.

Although a preferred embodiment has been shown and described in detail, it should be understood that various changes and modifications may be made therein without departing from the scope of the appended claims.

What is claimed is:

1. A front lay device for a sheet-fed rotary printing press, comprising:

a feed table having a front end;

a stop shaft disposed downwardly of said front end and reciprocably angularly movable about its own axis;

a stop holder mounted on said stop shaft and having a stop located adjacent to said front end of said feed table;

a swingable hold-down member pivotably mounted by a pivot shaft on said stop holder and having a hook-shaped distal end disposed adjacent to said front end of said feed table;

a cam shaft rotatable in synchronization with said stop shaft for driving said swingable hold-down member;

a link shaft drivable by said cam shaft for reciprocable angular movement about its own axis; and a quadruplet link mechanism for transmitting reciprocable angular movement of said link shaft as swinging movement to said swingable hold-down member to move the latter away from and toward an upper surface of said front end of said feed table while said stop shaft makes a single reciprocable angular movement, said link shaft and said pivot shaft serving as joints at two opposite ends of said quadruplet link mechanism.

2. A front lay device according to claim 1, wherein said link shaft has a link fastened thereto, and wherein said quadruplet link mechanism further comprises a connecting rod pivotably mounted at one end on said swingable hold-down member and at another opposite end to said link, respectively.

3. A front lay device according to claim 1, including a cam mounted on said cam shaft and having a cam surface, and a cam lever fixed to said link shaft and having a cam follower held against said cam surface.

4. A front lay device according to claim 1, wherein said swingable hold-down member has an adjustment screw adjustably held against said stop shaft for adjusting a gap between said hook-shaped distal end and said upper surface of said distal end of said feed table.

* * * * *